United States Patent [19]

Shibuya et al.

[11] Patent Number: 4,484,868

[45] Date of Patent: Nov. 27, 1984

[54] VANE COMPRESSOR HAVING IMPROVED COOLING AND LUBRICATION OF DRIVE SHAFT-SEAL MEANS AND BEARINGS

[75] Inventors: Tsunenori Shibuya; Masahiro Iio, both of Konan, Japan

[73] Assignee: Diesel Kiki Co. Ltd., Tokyo, Japan

[21] Appl. No.: 491,859

[22] Filed: May 5, 1983

[30] Foreign Application Priority Data

May 12, 1982 [JP] Japan ..... 57-79631

[51] Int. Cl.[3] ..... F04C 18/00; F04C 29/02

[52] U.S. Cl. ..... 418/15; 418/93; 418/100; 418/102; 418/268

[58] Field of Search ..... 418/86, 97–100, 418/102, 133, 259, 15, 93, 268

[56] References Cited

U.S. PATENT DOCUMENTS

| | | | |
|---|---|---|---|
| 2,018,341 | 10/1935 | Badger | 418/100 |
| 3,899,271 | 8/1975 | Glanvall | 418/102 |
| 3,988,080 | 10/1976 | Takada | 418/100 |
| 4,091,638 | 5/1978 | Mitch | 418/100 |
| 4,144,002 | 3/1979 | Shibuya et al. | 418/100 |

*Primary Examiner*—John J. Vrablik

*Attorney, Agent, or Firm*—Frishauf, Holtz, Goodman & Woodward

[57] ABSTRACT

A sealing chamber is defined between the front head and the front side block. The drive shaft on which the rotor is rigidly fitted is journalled by front and rear plain bearings provided on the front and rear side blocks, respectively. The bearing on the front side has an end portion remote from the rotor enclosedly disposed in the sealing chamber. The sealing chamber communicates in a direct manner with the suction port formed in the compressor casing by way of a passage means so as to be supplied in a direct manner with suction refrigerant having a low temperature and a low pressure.

10 Claims, 7 Drawing Figures

VANE COMPRESSOR HAVING IMPROVED COOLING AND LUBRICATION OF DRIVE SHAFT-SEAL MEANS AND BEARINGS

BACKGROUND OF THE INVENTION

This invention relates to a refrigerant compressor primarily for use in an air conditioning system for automotive vehicles, and more particularly to a vane compressor which has improved cooling and lubrication of the drive shaft-seal means and the drive shaft bearings.

Vane compressors are widely employed as refrigerant compressors in air conditioning systems for automotive vehicles, in general, by virtue of their simple construction and adaptability to operation at high rotational speeds. A typical conventional vane compressor of this kind comprises a pump housing formed of a cam ring and front and rear side blocks secured to opposite ends of the cam ring, and accommodating therein a rotor and vanes, a front head to which the front side block is secured, a drive shaft extending through the front and rear side blocks and the front head, and journalled by two radial bearings formed, respectively, on the front and rear side blocks, and a drive shaft-seal means arranged in a sealing chamber formed in the front head and fitted on the drive shaft to seal same against the front head.

In this conventional vane compressor, the front and rear side blocks are each formed with a radially extending lubricating oil feeding bore and an axially extending oil passage. The lubricating oil feeding bores each have one end opening in the discharge pressure chamber and the other end opening in the surface of the associated radial bearing disposed in sliding contact with the drive shaft. One of the oil passages communicates the sealing chamber with a back pressure chamber which communicates with the bottom of each of the vanes, while the other oil passage communicates an oil chamber disposed to enclose the rear end of the drive shaft with the back pressure chamber. During operation of the compressor, lubricating oil in the discharge pressure chamber is guided through each of the lubricating oil feeding bores and then the clearances between the drive shaft and the radial bearings to be fed into the sealing chamber on one hand, and into the oil chamber on the other hand, to lubricate the sliding surfaces of the above parts. The lubricating oil in the above clearances is also guided to the back pressure chamber to impart a predetermined back pressure to the vanes.

With this arrangement constructed as above, to keep the internal pressure of the back pressure chamber at a predetermined required level, the internal pressures of the sealing chamber and the oil chamber, both communicating with the back pressure chamber via the oil passages, also have to be maintained at the above-predetermined level. As a consequence, the sealing chamber and the oil chamber are supplied with lubricating oil having a relatively high pressure at substantially the same level with the back pressure as well as a relatively high temperature due to the heat of compressed refrigerant, causing insufficient lubrication and cooling of the radial bearings and the drive shaft-seal means, which can result in seizure of these parts as well as leakage of lubricating oil and refrigerant through the sealing chamber.

OBJECTS AND SUMMARY OF THE INVENTION

It is an object of the invention to provide a vane compressor which is constructed such that suction refrigerant having a low pressure and a low temperature is supplied to the sealing chamber and the radial bearings supporting the drive shaft, to thereby prevent seizure of the drive shaft-seal means in the sealing chamber and the radial bearings, as well as leakage of lubricating oil and refrigerant through the sealing chamber.

It is a further object of the invention to provide a vane compressor which is constructed such that both of the sealing chamber and the back pressure chamber are positively supplied with sufficient amounts of lubricating oil.

The present invention provides a vane compressor which comprises a suction chamber defined between the front head and the front side block and communicating with at least one pump working chamber on the suction stroke by way of at least one pump inlet formed in the pump housing which is formed by the front and rear side blocks and the cam ring. The front side block is provided with a front plane bearing which radially supports the drive shaft, which has an end portion remote from the rotor enclosedly disposed in a sealing chamber which is defined between the front head and the front side block. Further provided is a passage means communicating in a direct manner the suction port formed in the compressor casing which is formed by the front head and a covering, with the sealing chamber to supply the sealing chamber with suction refrigerant under low pressure and at a low temperature.

The above and other objects, features and advantages of the invention will be more apparent from the ensuing detailed description taken in connection with the accompanying drawings.

DETAILED DESCRIPTION

Figure 1:
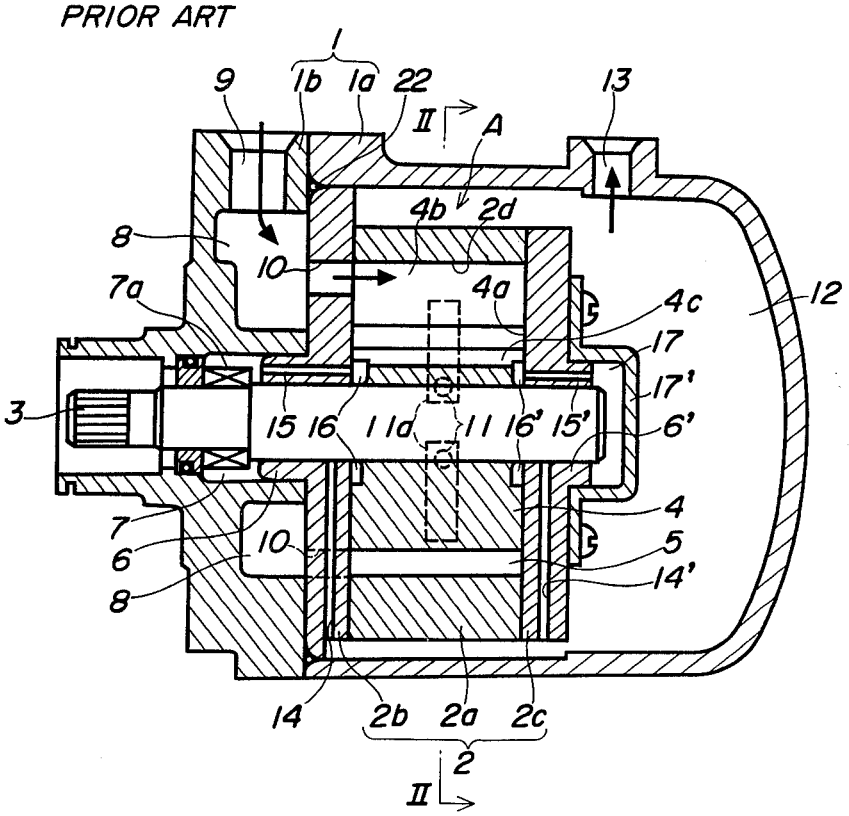
FIG.1 PRIOR ART
FIG. 1 is a longitudinal vertical sectional view of a conventional vane compressor of the diametrically symmetrical double chamber type.
Figure 2:
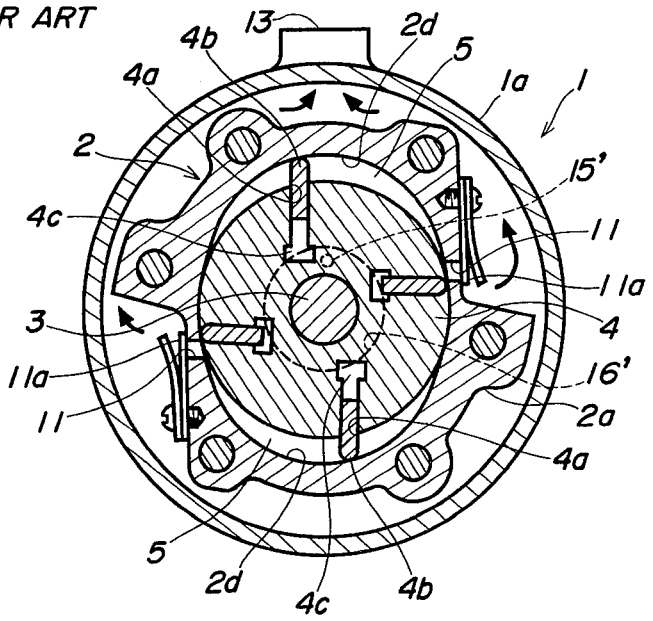
FIG.2 PRIOR ART
FIG. 2 is a cross-sectional view taken along line II—II in FIG. 1.

Referring first to FIGS. 1 and 2, there is illustrated a conventional vane compressor of the symmetrical double chamber type. A compressor casing 1 is formed by a generally cylindrical covering 1*a* and a front head 1*b*, within which is accommodated a pump housing 2 formed of an ellipsoidal cam ring 2*a* and front and rear side blocks 2*b* and 2*c* secured, respectively, to the front and rear end faces of the cam ring 2*a*. The front side block 2*b* is fixed to the front head 1*b* in a manner that the pump housing 2 is supported by the front head 1*b*. The covering 1*a* is joined to the front head 1*b* by means of bolts, not shown, with its open end abutting against the front head 1*b* in a gastight manner with an annular sealing member 22 interposed therebetween. The pump housing 2 accommodates a cylindrical rotor 4 rigidly fitted on a drive shaft 3, which cooperates with the pump housing 2 to form a pump assembly A and has a plurality of axial slits 4*a* formed in its outer peripheral surface and carries as many plate-like vanes 4*b* fitted in the slits 4*a* for radial movement. Pump working chambers 5 are defined between the rotor 4, adjacent vanes 4*b*, the endless camming inner peripheral surface 2*d* of the cam ring 2*a*, and the inner end faces of the opposite front and rear side blocks 2*b*, 2*c*. The drive shaft 3 extends through the front side block 2*b* and the rear side block 2*c*, and journalled by front and rear radial bearings 6 and 6' formed integrally with the front and rear side blocks 2*b* and 2*c*, respectively. A sealing chamber 7 is formed within the front head 16, and defined by the front head 1*b* and the front side block 2*b*. A drive shaft-seal means 7*a* is arranged in the sealing chamber 7 and fitted on the drive shaft 3 which extends through the drive shaft-seal means 7*a*, in a gastight manner, to thus seal the drive shaft 3 against the front head 1*b*.

Disposed around the sealing chamber 7 in the front head 1*b* is a suction chamber 8 which is annular in shape and defined by the front head 1*b* and the front side block 2*b*. This suction chamber 8 communicates, on one hand, with a suction port 9 formed in an upper portion of the front head 1*b*, and on the other hand, with volume-increasing pump working chambers 5 on suction stroke, through pump inlets 10 formed through the front side block 2*b*. The volume-decreasing pump working chambers 5 on discharge stroke can communicate with a discharge pressure chamber 12 defined within the covering 1*a* at a rear side of the pump housing 2, by way of pump outlets 11 formed through the cam ring 2*a*, discharge valves 11*a*, and gaps between the pump housing 2 and the covering 1*a*, while the discharge pressure chamber 12 communicates with a discharge port 13 formed through an upper portion of the covering 1*a*.

Lubricating oil feeding bores 14 and 14' are formed in the front side block 2*b* and the rear side block 2*c*, respectively, starting from lower peripheral surfaces of the respective side blocks and opening in inner peripheral surface of the respective plane bearings 6, 6', while oil passages 15 and 15' axially penetrate the respective bearings 6, 6'. On the other hand, the rotor 4 has its front and rear end faces formed with annular grooves 16 and 16' disposed around the drive shaft 3, which both communicate, on one hand, with clearances between the drive shaft 3 and the respective bearings 6, 6', and on the other hand with a back pressure chamber 4*c* formed within the rotor 4, the back pressure chamber 4*c* in turn communicating with the bottoms of the slits 4*a*. The above-mentioned oil passage 15 communicates the annular groove 16 on the front side with the sealing chamber 7, while the other oil passage 15' communicates the other annular groove 16' on the rear side with an oil chamber 17 defined within a covering plate 17' which is secured to the rear side block 2*c* in a manner covering a rear end face of the same block 2*c* formed with the bearing 6'.

With the above-described conventional arrangement, when the drive shaft 3 rotates, which is usually rotated in unison with an engine, not shown, on an associated automotive vehicle, not shown, and accordingly the rotor 4 also rotates, the vanes 4*b* rotate together with the rotor 4 while radially moving with their tips sliding on the camming inner peripheral surface 2*d* of the cam ring 2*a* due to centrifugal force and back pressure caused by the lubricating oil. As each pump working chamber 5 goes through the suction stroke, refrigerant is forcedly introduced into the suction chamber 8 through the suction port 9, and sucked into the same chamber 5 through the corresponding pump inlet, while as the chamber 5 goes through the compression stroke, the suction refrigerant is compressed. At the subsequent discharge stroke, the compressed refrigerant is discharged into the discharge pressure chamber 12 through the pump outlets 11 and the forcedly opened discharge valves 11*a*, for temporary storage therein. Thereafter, the discharge refrigerant is supplied into the refrigerating circuit, not shown, through the discharge port 13. The above suction, compression and discharge strokes are repeatedly carried out to perform a refrigerant compressing action.

The lubricating oil mixed in the refrigerant is separated from the refrigerant in the discharge pressure chamber 12 and stored at the bottom of the same chamber 12. Due to high discharge pressure in the discharge pressure chamber 12, the lubricating oil at the bottom of the chamber 12 is forcedly guided along the lubricating oil feeding bores 14, 14'. The lubricating oil in the bore 14 formed in the front side block 2*b* then travels through a small clearance between the bearing 6 on the front side and the drive shaft 3, where it is divided into two axially opposite flows to lubricate the bearing 6. One of the two flows is guided into the sealing chamber 7 and the other flow into the annular groove 16 on the front side. The lubricating oil guided into the sealing chamber 7 lubricates the drive shaft-seal means 7*a* therein and then guided into the annular groove 16 on the front side through the oil passage 15, part of which flows into the back pressure chamber 4*c* to impart back pressure to radially inward end faces of the vanes 4*b*, and the other part is forced into the gap between the rotor 4 and the front side block 2*b* to lubricate their sliding surfaces and then into the pump working chambers 5. On the other hand, another part of the lubricating oil stored at the bottom of the covering 1*a* and forcedly fed through the lubricating oil feeding bore 14' formed in the rear side block 2*c* flows into a small clearance between the bearing 6' on the rear side and the drive shaft 3, where it is divided into two axially opposite flows to lubricate the same bearing 6'. The lubricating oil in the clearance is delivered into the annular groove 16' directly or by way of the oil chamber 17 and the oil passage 15'. After this, it is guided into the back pressure chamber 4*c* to impart back pressure to the vanes 4*b* and forced into the gap between the rotor 4 and the rear side block 2*c* to lubricate their sliding surfaces and then into the pump working chambers 5. In the pump working chambers 5, the lubricating oil lubricates the sliding surfaces of the vanes 4*b* and the pump housing 2, and discharged into the discharge pressure chamber 12 together with the discharge refrigerant, where it is again separated from the refrigerant and stored in the bottom of the chamber 12. In this manner, the above-described cycle of lubricating oil is repeated.

According to the conventional vane compressor described above, high pressure of about 15 kg/cm$^2$ prevails in the discharge pressure chamber 12 and forces the lubricating oil stored therein to travel through the lubricating oil feeding bores 14, 14' to the sliding surfaces of the plane bearings 6, 6'. In each of the bearings 6, 6', the lubricating oil is divided into two axially opposite flows. Part of the lubricating oil guided up to the bearings 6 and 6' is supplied to the sealing chamber 7 and the oil chamber 17 through small clearances between the drive shaft 3 and the respective plain bearings 6 and 6', while simultaneously its pressure is gradually decreased. Preferably, the internal pressure of the back pressure chamber 4c in the rotor 4 should be maintained at about 8.5 kg/cm$^2$ which is a mean value of the discharge pressure (about 15 kg/cm$^2$) and the suction pressure (about 2 kg/cm$^2$), so as to impart a required back pressure to the vanes 4b. To this end, the flow resistance between the lubricating oil feeding bore 14 and the sealing chamber 7 and that between the lubricating oil feeding bore 14' and the oil chamber 17, i.e. the clearances between the drive shaft 3 and the respective plain bearings 6 and 6' are set such that the sealing chamber 7 and the oil chamber 17 both interconnecting the back pressure chamber 4c and the respective bores 14 and 14' are subject to the mean pressure of about 8.5 kg/cm$^2$. Such being the circumstances, according to the conventional vane compressor, the sealing chamber 7 and the oil chamber 17 are supplied with hot lubricating oil under relatively high pressure of about 8.5 kg/cm$^2$, which has been heated by the compressed refrigerant, and therefore sufficient lubrication and cooling of the bearings 6, 6' and the drive shaft-seal means 7a cannot be achieved, causing seizure of the sliding portions of the compressor, and leakage of lubricating oil and refrigerant through the drive shaft-seal means 7a in the sealing chamber 7.

FIGS. 3 through 7 illustrate embodiments of the present invention. In these figures, elements and parts corresponding to those in FIGS. 1 and 2 are designated by identical reference numerals.

Figure 3:
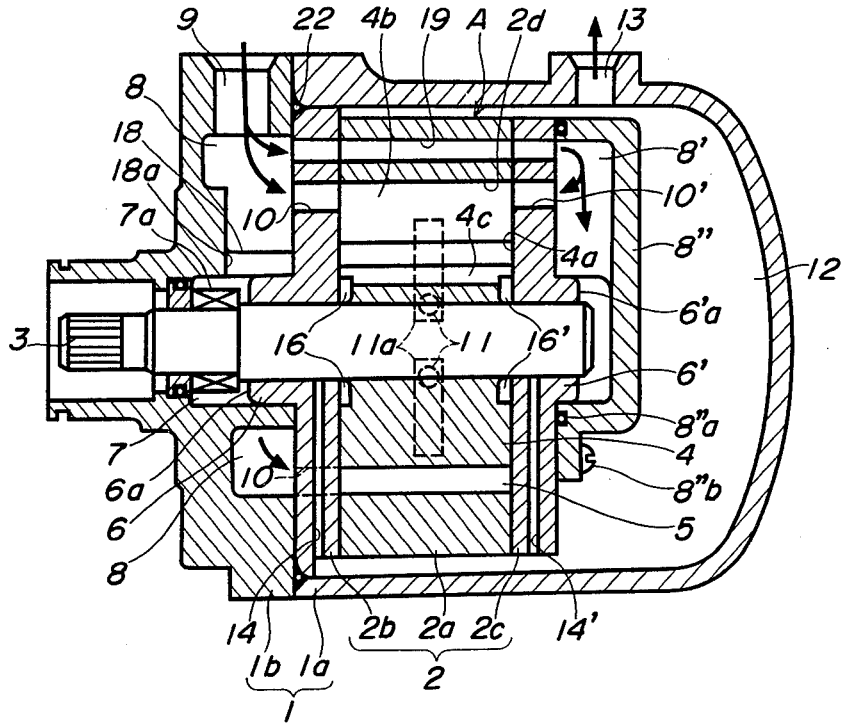
FIG. 3 is a longitudinal vertical sectional view of a vane compressor according to a first embodiment of the present invention.
Figure 4:
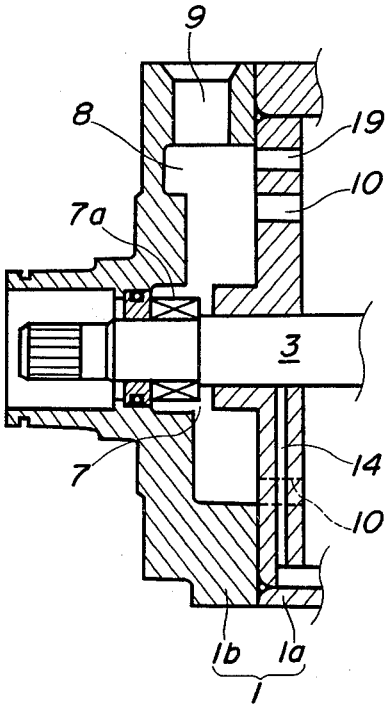
FIG. 4 is a fragmentary longitudinal sectional view of a portion of the compressor of FIG. 3 encircling the drive shaft-seal means, showing a variation of the same means.
Figure 5:
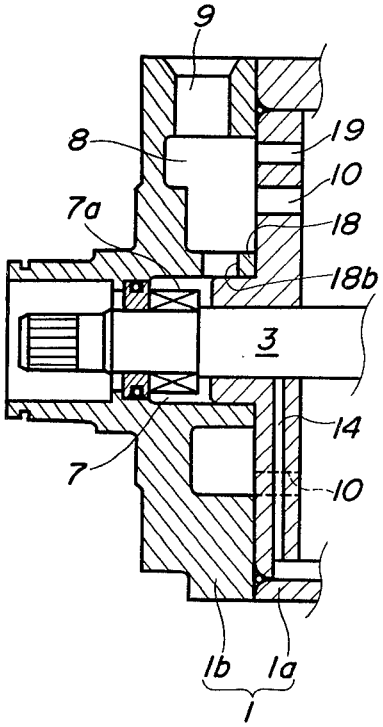
FIG. 5 is a view similar to FIG. 4, illustrating another variation of the drive shaft-seal means.

Referring first to FIG. 3, a first embodiment of the invention is illustrated. As distinct from the conventional compressor of FIGS. 1 and 2, the plain bearings 6 and 6' of the compressor according to this invention in FIG. 3 are not formed with oil passages corresponding to the oil passages 15 and 15' appearing in FIGS. 1 and 2 which communicate the respective annular grooves 16 and 16' with the sealing chamber 7 and the oil chamber 17. This is because, according to this invention, the internal pressures of the sealing chamber 7 and the oil chamber 17 are kept at almost the same level with the suction pressure, due to a unique construction described hereinbelow. That is, a cylindrical partition wall 18, which is formed integrally with the front head 1b and receives therein an end portion of the bearing 6 to separate the sealing chamber 7 from the surrounding suction chamber 8, has its peripheral edge cut away in part to form a cut-out portion or opening 18a communicating the sealing chamber 7 with the front suction chamber 8. Alternatively, as shown in FIG. 4, the whole partition wall 18 may be omitted so that the sealing chamber 7 and the front suction chamber 8 together form a single unitary chamber communicating with the suction port 9. As a further alternative, the partition wall 18 may be formed with at least one through hole 18b radially extending through the wall 18, as shown in FIG. 5.

A partition wall member 8'' is secured to the rear end face of the rear side block 2c by means of screws 8''b in an airtight manner with a sealing member 8''a interposed therebetween. A rear suction chamber 8' is defined between the rear side block 2c and the partition wall member 8'' and communicates with the front suction chamber 8 by way of a suction passage 19 axially extending through the front side block 2b, the cam ring 2a and the rear side block 2c at an upper portion of the pump housing 2, to be supplied with suction refrigerant through the passage 19 from the chamber 8. The rear side block 2c is formed with a pump inlet 10' communicating the rear suction chamber 8' with one pump working chamber 5. Alternatively of the above suction passage 19 which is formed through the pump housing 2 may be provided an independent hollow tubular member having its interior serving as such suction passage, or any other variations of the suction passage 19 are possible insofar as they communicate the suction port 9 with the rear suction chamber 8'. For instance, in FIG. 7 referred to hereinbelow, a hollow passage defining portion 9'' functions as the suction passage, which extends from a suction port 9' formed in the rear end wall of the covering 1a to the rear suction chamber 8'.

According to the invention, the rear suction chamber 8' also functions as the oil chamber 17 of the conventional vane compressor of FIG. 1, wherein an end portion of the rear side plain bearing 6' remote from the rotor 4 is disposed within the rear suction chamber 8'. With this arrangement, the sealing chamber 7 communicating directly with the front suction chamber 8 as noted above is subject to the pressure of suction refrigerant supplied thereto through the suction port 9, which is within a low suction pressure range (about 2 kg/cm$^2$). On the other hand, since the rear suction chamber 8' communicates with the front suction chamber 8 by way of the suction passage 19, the end face 6'a of the plane bearing 6' in the rear suction chamber 8' is subject to pressure which is substantially within the suction pressure range.

Figure 6:
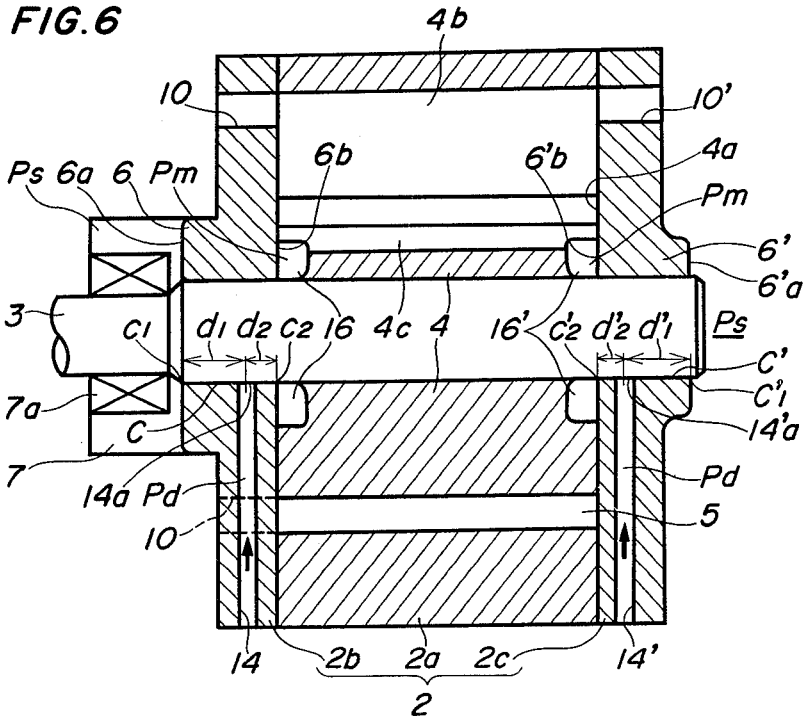
FIG. 6 is an enlarged fragmentary sectional view of the compressor of FIG. 3, showing locations of the lubricating oil feeding bores.

FIG. 6 shows in detail the locations of the lubricating oil feeding bores 14, 14' relative to the front and rear plain bearings 6 and 6'. The lubricating oil in the lubricating oil feeding bores 14, 14' communicating directly with the discharge pressure chamber 12 is subject to high pressure Pd (about 15 kg/cm$^2$) of the compressed refrigerant in the discharge pressure chamber 12, whereas the end faces 6a, 6'a of the plain bearings 6, 6' remote from the rotor 4 and their vicinities in the front and rear suction chambers 8, 8' are subject to low pressure Ps (about 2 kg/cm$^2$) which is within the suction pressure range. Preferably, the pressure in the annular grooves 16, 16' communicating with the back pressure chamber 4c within the rotor 4 should be kept at a predetermined required back pressure level i.e. at a mean level Pm of about 8.5 kg/cm$^2$, by supplying a necessary proper amount of lubricating oil under high pressure to the grooves 16, 16'. However, if the lubricating oil feeding bores 14 and 14' are arranged to open in the axially central portions of the respective plain bearings 6 and 6', the flow resistance between the upper end 14a of the bore 14 opening in the bearing 6 and the sealing chamber 7 is substantially the same as that between the open end 14a and the annular groove 16, and also the flow resistance between the upper end 14'a of the bore 14' opening in the bearing 6' and the rear suction chamber 8' is substantially the same as that between the open end 14'a and the annular groove 16'. Consequently, a greater part of the lubricating oil under high pressure which is guided up to the open ends 14a, 14'a of the bores 14, 14' flows toward the sealing chamber 7 and the rear suction chamber 8' where relatively low pressure prevails, whereas the annular grooves 16, 16' under relatively high pressure are supplied with an insufficient amount of the lubricating oil, resulting in a difficulty to impart the mean pressure Ps to the annular grooves 16, 16' which is necessary to apply sufficient back pressure to the vanes 4b against the camming surface 2d.

To eliminate the drawback set forth above, according to the invention as shown in FIG. 6, the open ends 14a, 14'a of the lubricating oil feeding bores 14, 14' are so located as to satisfy the relationships of $d_1 > d_2$, $d'_1 > d'_2$, where $d_1$ represents the distance between the open end 14a of the bore 14 and the outer end $C_1$ of the clearance C between the drive shaft 3 and the front bearing 6, remote from the rotor 4, $d_2$ the distance between the open end 14a of the bore 14 and the inner end $C_2$ of the clearance C facing the rotor, $d'_1$ the distance betwen the open end 14'a of the bore 14' and the inner end $C'_1$ of the clearance C' between the drive shaft 3 and the rear bearing 6', remote from the rotor 4, and $d'_2$ the distance between the open end 14'a of the bore 14' and the outer end $C'_2$ of the clearance C' facing the rotor, respectively. This makes up for the pressure difference that the difference Pd−Pm between the pressure at the open ends 14a, 14'a and the pressure in the annular grooves 16, 16' is smaller than the difference Pd−Ps between the pressure at the open ends 14a, 14'a and the pressure at the outer end faces 6a, 6'a of the bearings 6, 6' (i.e. Pd−Pm<Pd−Ps). Since the open ends 14a, 14'a of the lubricating oil feeding bores 14, 14' are thus suitably located in accordance with the relationship of Pd−Pm<Pd−Ps, more specifically, the ratio of $d_1/(d_1+d_2)$ and the ratio of $d_1/(d'_1+d'_2)$ are both set at values in proportion to the difference Pd−Ps between the suction pressure of refrigerant and the discharge pressure of same, the annular grooves 16, 16' will be supplied with a required or proper amount of lubricating oil enough to keep the pressure in the back pressure chamber 4c at a required level. At the same time, the sealing chamber 7 will be supplied with a sufficient amount of lubricating oil for sufficient lubrication and cooling of the drive shaft-seal means 7a.

The other elements and parts in the embodiment of FIGS. 3 and 4, not referred to above, are similar to those of the conventional vane compressor in FIG. 1, description of which is therefore omitted.

The operation of the vane compressor of this embodiment will now be described. When the drive shaft 3 rotates in unison with rotation of the engine of an associated automotive vehicle or a like prime mover rotates, and accordngly the rotor 4 rotates, the vanes 4b rotate together with the rotor 4 while radially moving with their tips sliding on the camming inner peripheral surface 2d of the cam ring 2a due to centrifugal force and back pressure caused by the lubricating oil in the back pressure chamber 4c. During suction stroke, refrigerant having a low temperature is introduced into the front suction chamber 8 via the suction port 9 and cools the plain bearing 6 of the front side block 2b, part of which is guided into the sealing chamber 7 through the opening 18a to maintain the pressure therein within the low suction pressure range (about 2 kg/cm$^2$) as well as to cool the drive shaft-seal means 7a in the sealing chamber 7, and is thereafter sucked into the pump working chambers 5 via the pump inlets 10 in the front side block 2b together with the greater part of the remaining suction refrigerant. The smaller part of the remaining suction refrigerant in the front suction chamber 8 passes through the suction passage 19 into the rear suction chamber 8' to keep the pressure in the vicinity of the outer end face 6'a of the plain bearing 6' within the low suction pressure range, as well as to cool the same bearing 6', and is thereafter sucked into one of the pump working chambers 5 via the pump inlet 10' in the rear side block 2c. The refrigerant sucked into the pump working chambers 5 is compressed on the compression stroke thereof and discharged into the discharge pressure chamber 12 through the pump outlets 11 and the discharge valves 11a, for temporary storage therein. Thereafter, the discharge refrigerant in the chamber 12 is supplied into the refrigerating circuit, not shown, through the discharge port 13. The above suction, compression and discharge strokes are repeatedly carried out to perform a refrigerant compressing action.

The lubricating oil is separated from the refrigerant in the discharge pressure chamber 12 and stored at the bottom of same, from which it is forcedly guided, due to the high compression pressure Pd (about 15 kg/cm$^2$) in the discharge pressure chamber 12, through the lubricating oil feeding bores 14, 14' into the smaller clearances between the drive shaft 3 and the respective plain bearing 6, 6', where the lubricating oil is divided into two axially opposite flows. One of the flows travels through the above clearances which have relatively small values of flow resistance corresponding to the respective relatively short distances $d_2$, $d'_2$, into the respective annular grooves 16, 16', due to the pressure difference Pd−Pm, and thereafter into the back pressure chamber 4c to keep the pressure therein at the level of mean pressure Pm of about 8.5 kg/cm$^2$. The lubricating oil thus introduced into the annular grooves 16, 16' is then guided into the pump working chambers 5 through the gap between the rotor 4 and the vanes 4b as well as the gaps between the rotor and the pump housing 2, while lubricating the sliding surfaces of the rotor 4, the vanes 4b and the pump housing 2. On the other hand, the other flow of the lubricating oil in the above-mentioned clearances travels through the same clearances over the respective distances $d_1$, $d'_1$, due to the pressure difference Pd−Ps, to the outer end faces 6a, 6'a of the respective bearings 6, 6' to lubricate sliding surfaces of the bearings 6, 6' and the drive shaft 3. The lubricating oil fed to the outer end faces 6a of the bearing 6 on the front side is then introduced into the sealing chamber 7 to lubricate the drive shaft-seal means 7a therein. Since as noted above, the lubricating oil feeding bores 14, 14' open in the sliding surfaces of the respective bearings 6, 6' at predetermined suitable locations corresponding to the values of Pd−Ps and Pd−Pm, a sufficient or suitable amount of lubricating oil is supplied to each of the back pressure chamber 4c, the sealing chamber 7 and the rear suction chamber 8', ensuring application of required sufficient back pressure to the vanes 4b as well as sufficient lubrication and cooling of the sliding surfaces of the various parts of the compressor.

The lubricating oil guided into the front and rear suction chambers 8, 8' through the clearances between the drive shaft 3 and the respective bearings 6, 6' is sucked into the pump working chambers 5 together with the suction refrigerant, where it is mixed with the lubricating oil introduced into the same chambers 5 through the gaps between the rotor and the pump housing 2 as well as the gaps between the rotor and the vanes 4b, and discharged into the discharge pressure chamber 12 together with the compressed refrigerant. In the discharge pressure chamber 12, the lubricating oil is again separated from the refrigerant. The above cycle of lubricating oil is repeated.

Figure 7:
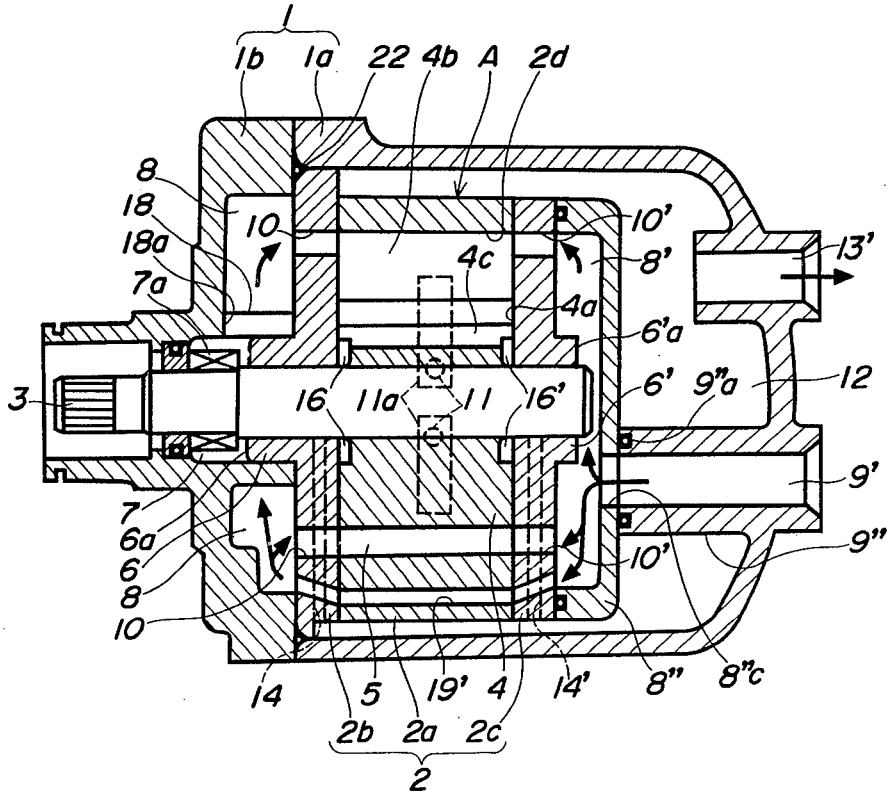
FIG. 7 is a longitudinal vertical sectional view of a vane compressor according to a second embodiment of the invention.

FIG. 7 illustrates another embodiment of the invention in which the invention is applied to a vane compressor which has a suction port 9' and a discharge port 13' located at a rear portion thereof. In this figure, elements and parts corresponding to those in the vane compressors previously described are designated by identical reference numerals. In this embodiment, the covering 1*a* has its rear end wall formed integrally with the suction port 9' and a hollow passage defining portion 9'' which has one end in alignment with the suction port 9'. The hollow passage defining portion 9' has its other end fixed to the partition wall member 8'' in alignment with a through bore 8''*c* formed in the wall member 8'', and with a sealing member 9''*a* interposed therebetween. The suction port 9' is in direct communication with the rear suction chamber 8' defined between the partition wall member 8'' and the rear side block 2*c* by way of the hollow passage defining portion 9' axially extending through the discharge pressure chamber 12. The rear suction chamber 8' in turn communicates, on one hand, with the front suction chamber 8 by way of a suction passage 19' extending through the rear side block 2*c*, the cam ring 2*a* and the front side block 2*b* at a lower portion of the pump housing 2, and on the other hand, with the pump working chambers 5 through the pump inlets 10' formed through the rear side block 2*c*. The other elements and parts of the compressor not referred to above are identical in arrangement and construction with those in the first embodiment previously described. For instance, the front suction chamber 8 communicates with the sealing chamber 7 in the front head 1*b* through the opening 18*a* formed in the partition wall 18, and also communicates with the pump working chambers 5 via the pump inlets 10. That is, the sealing chamber 7 and the end face 6'*a* of the bearing 6' remote from the rotor 4 are in substantially direct communication with the suction port 9' so that they are subject to low pressure of the suction refrigerant. Therefore, the drive shaft-seal means 7*a* in the sealing chamber 7 and the bearings 6, 6' disposed, respectively, in the sealing chamber 7 and in the rear suction chamber 8' can be adequately lubricated and cooled by the suction refrigerant having low pressure and low temperature.

According to the invention described above, the sealing chamber 7 and the end portion of the rear plain bearing 6' remote from the rotor are disposed in substantially direct communication with the suction port 9, 9' through which suction refrigerant having low temperature and low pressure is introduced into the compressor, and accordingly the drive shaft-seal means 7*a* and the front plain bearing 6 disposed in the sealing chamber 7, as well as the rear plain bearing 6' are supplied with suction refrigerant in a direct manner to be cooled thereby, resulting in prevention of seizure of their sliding portions. Further, the low pressure of the suction refrigerant prevailing around the drive shaft-seal means 7*a* can prevent leakage of refrigerant and lubricating oil therethrough.

Although in the foregoing embodiments, the invention has been applied to vane compressors of the diametrically symmetrical double chamber type, the invention may equally be applied to a vane compressor of the single chamber type or of the other multi-chamber type.

Obviously many modifications and variations of the present invention are possible in the light of the above teachings. It is therefore to be understood that within the scope of the appended claims the invention may be practiced otherwise than as specifically described.

What is claimed is:

1. A vane compressor comprising: a cam ring having an endless camming inner peripheral surface and opposite ends; front and rear side blocks secured to said opposite ends of said cam ring and forming a pump housing in cooperation with said cam ring, said pump housing having at least one pump inlet and at least one pump outlet; a cylindrical rotor accommodated within said pump housing and having an outer peripheral surface thereof formed with a plurality of slits; a plurality of vanes radially slidably fitted in said slits of said rotor for sliding on said endless camming inner peripheral surface of said cam ring, adjacent ones of said vanes cooperating with said pump housing and said rotor to define therebetween pump working chambers communicating with said pump inlets or said pump outlet; a front head secured to said front side block; a drive shaft partly disposed in said pump housing and supporting said rotor; a covering cooperating with said front head to form a compressor casing, said compressor casing having a suction port and a discharge port formed therein, said suction port communicating with said at least one pump inlet of said pump housing, said discharge port being disposed for communication with said at least one pump outlet of said pump housing; a sealing chamber defined by said front head and said front side block; a drive shaft-seal means arranged in said sealing chamber and fitted on said drive shaft in a gastight manner; a suction chamber defined by said front head and said front side block and disposed around said sealing chamber, said suction chamber communicating with at least one of said pump working chambers on a suction stroke thereof through said at least one pump inlet; a front plain bearing provided at said front side block and radially supporting said drive shaft, said front plain bearing having an end portion remote from said rotor disposed in said sealing chamber; a first passage means communicating in a direct manner said suction port with said sealing chamber to introduce suction refrigerant having low pressure and low temperature into said sealing chamber; a partition member secured to an end face of said rear side block remote from said rotor and cooperating with said rear side block to define a rear suction chamber therebetween, said rear suction chamber communicating with at least one of said pump working chambers through said at least one pump inlet; a rear plain bearing provided at said rear side block and radially supporting said drive shaft, said rear plain bearing having an end portion remote from said rotor disposed in said rear suction chamber; and a second passage means communicating in a direct manner said suction port with said end portion of one of said plain bearings formed in said rear side block remote from said rotor to guide suction refrigerant to said end portion of said one plain bearing.

2. A vane compressor as claimed in claim 1, wherein said first passage means comprises said front suction chamber and a communication means communicating said front suction chamber with said sealing chamber.

3. A vane compressor as claimed in claim 2, including a partition wall extending between said front head and said front side block and separating said sealing chamber from said front suction chamber, and wherein said communication means comprises a cut-out portion formed in at least part of said partition wall.

4. A vane compressor as claimed in claim 2, including a partition wall extending between said front head and said front side block and separating said sealing chamber from said front suction chamber, and wherein said communication means comprises at least one through hole formed through said partition wall.

5. A vane compressor as claimed in claim 2, wherein said second passage means comprises a passage axially extending through said pump housing at a peripheral portion thereof, said axially extending passage having one end opening in said rear suction chamber and another end opening in said front suction chamber.

6. A vane compressor as claimed in claim 1, wherein said covering has a rear end wall formed with said suction port and said discharge port, said partition member having an opening formed therein, said second passage means comprising a hollow passageway having one end disposed in alignment with said suction port and joined to said rear end wall of said covering and another end disposed in alignment with said opening of said partition member and joined to said partition member.

7. A vane compressor as claimed in claim 6, wherein said first passage means comprises a passage axially extending through said pump housing at a peripheral portion thereof, said axially extending passage having one end opening in said rear suction chamber and another end opening in said front suction chamber.

8. A vane compressor as claimed in any one of claims 1 and 2 through 8, wherein said rotor has a back pressure chamber formed therein, said front and rear side blocks each having a lubricating oil feeding passage formed therein and having one end opening in a discharge pressure zone of the vane compressor and another end opening in a clearance between said drive shaft and an associated one of said plain bearings, said clearances each having an inner end and an outer end and communicating with said back pressure chamber, said another end of said lubricating oil feeding passage being located so as to satisfy the following relationships:

$$d_1 > d_2 \quad (1) \text{ and}$$

$$d'_1 > d'2 \quad (2);$$

where $d_1$: the distance between said another end of said lubricating oil passage provided in said front side block and said outer end of said clearance provided at said front side block remote from said rotor;

$d_2$: the distance between said another end of said lubricating oil passage provided in said front side block and said inner end of said clearance provided at said front side block facing said rotor;

$d'_1$: the distance between said another end of said lubricating oil passage provided in said rear side block and said outer end of said clearance provided at said rear side block remote from said rotor; and $d'_2$: the distance between said another end of said lubricating oil passage provided on said rear side block and said inner end of said clearance provided at said rear side block facing said rotor.

9. A vane compressor as claimed in claim 8, wherein the ratio of $d_1/(d_1+d_2)$ and the ratio of $d'_1/(d'_1+d'_2)$ are both set at values in proportion to the difference between the suction pressure of refrigerant and the discharge pressure of same.

10. A vane compressor as claimed in claim 8, wherein said rotor has opposite end faces each formed with an annular groove extending around said drive shaft, said annular grooves each communicating said back pressure chamber with an associated one of said clearances formed between said drive shaft and said plain bearings.

* * * * *